US007074097B1

(12) United States Patent
Seymour, II et al.

(10) Patent No.: US 7,074,097 B1
(45) Date of Patent: Jul. 11, 2006

(54) MARINE EXHAUST SYSTEM WITH AN EXHAUST FLOW DIRECTING DEVICE

(75) Inventors: Kenneth R. Seymour, II, Sheboygan, WI (US); Anthony M. Straub, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/143,389

(22) Filed: Jun. 2, 2005

(51) Int. Cl.
*B63H 21/32* (2006.01)

(52) U.S. Cl. ..... 440/89 R

(58) Field of Classification Search ..... 440/89 D, 440/89 R; 60/272, 298, 299, 302
See application file for complete search history.

(56) References Cited

U.S. PATENT DOCUMENTS 3,967,446 A 7/1976 Harralson et al. ..... 60/312
4,668,199 A 5/1987 Freund et al. ..... 440/89
4,952,182 A 8/1990 Curtis et al. ..... 440/89
5,041,036 A 8/1991 Clark et al. ..... 440/89
5,378,180 A * 1/1995 Nakayama et al. ..... 440/89 R
5,524,578 A 6/1996 Craft et al. ..... 123/65 P
5,595,515 A * 1/1997 Hasegawa et al. ..... 440/89 R
6,663,451 B1 12/2003 Walczak ..... 440/89 R
6,746,290 B1 * 6/2004 Nakata et al. ..... 440/89 R
6,851,257 B1 * 2/2005 Yoshida et al. ..... 440/89 R

* cited by examiner

*Primary Examiner*—Lars A. Olson
(74) *Attorney, Agent, or Firm*—William D. Lanyi

(57) ABSTRACT

An exhaust system for a marine engine provides a flow directing component that reacts to changes in engine speed to select an appropriate and advantageous direction of fluid flow through the flow directing component. At speeds below a first threshold speed magnitude, such as an idle speed, exhaust gases pass from a first exhaust passage, through the flow directing component, and out of the marine propulsion device through an above-water exhaust conduit. When the engine is operating at speeds above a second threshold speed magnitude, the flow directing component operates according to Venturi principles to lower the pressure at its first end and draw ambient air through the second exhaust passage into the first exhaust passage.

20 Claims, 5 Drawing Sheets

MARINE EXHAUST SYSTEM WITH AN EXHAUST FLOW DIRECTING DEVICE

BACKGROUND OF THE INVENTION

1. Field of the Invention

The present invention is generally related to an exhaust system for a marine propulsion device and, more particularly, to an exhaust system which automatically controls the direction of the flow of fluid through an idle relief passage as a function of engine operating speed.

2. Description of the Related Art

Those skilled in the art of marine engines are familiar with various types of idle relief systems which allow exhaust to be emitted from the marine propulsion device above the water level of a body of water when the engine is operating at idle speed but, when the engine is operating at increased speeds, direct the exhaust flow to a position below the level of the water in which the marine propulsion device is operating.

U.S. Pat. No. 3,967,446, which issued to Harralson et al. on Jul. 6, 1976, discloses an exhaust relief silencing apparatus for marine propulsion systems. A tuned exhaust gas relief system includes a lowered driveshaft housing coupled to a two stroke engine by a pair of intermediate stacked exhaust extension plates. The housing directs the exhaust gas downwardly to a through-the-hub exhaust propeller for exit therethrough. With the unit in reverse or idling, exhaust gases are trapped within the housing. A pair of tuned exhaust relief passageways may be formed by cavities in the mating faces of the two extension plates with a pair of inlet openings in the lower wall of the bottom plate.

U.S. Pat. No. 4,668,199 which issued to Freund et al. on May 26, 1987, discloses an idle exhaust relief system for outboard motors. The system includes a main exhaust passageway extending through a partially water filled chamber in the driveshaft housing. An inlet idle relief passage connects the top of the chamber with the main exhaust passageway and an outlet passage connects the top of the chamber with the atmosphere. The system thus defines an effective exhaust silencer for the idle exhaust.

U.S. Pat. No. 4,952,182, which issued to Curtis et al. on Aug. 28, 1990, discloses a noise attenuating exhaust relief system for an outboard motor. It includes an exhaust chamber into which exhaust is discharged from the engine. A first passage in communication with the exhaust chamber provides contraction of the exhaust as the exhaust passes rearwardly, from which the exhaust is discharged into an expansion chamber which substantially surrounds the exhaust chamber. From the expansion chamber, the exhaust is routed through and contracted into a second passage in communication with the expansion chamber, after which it is discharged to the atmosphere. The tortuous path provided by the exhaust relief system, along with the repeated expansion and contraction of the exhaust as it flows to atmosphere, provides a muffling effect at idle operation.

U.S. Pat. No. 5,041,036, which issued to Clark et al. on Aug. 20, 1991, describes an idle exhaust gas relief arrangement for an outboard motor. The outboard motor comprises an internal combustion engine including a lower surface having therein an exhaust gas discharge port, a driveshaft housing having an upper end including an upper face fixed to the lower surface of the internal combustion engine, an outer surface extending downwardly from the upper face, an interior vertically extending main exhaust gas passage extending from the upper face and communicating with the exhaust gas discharge port, an idle exhaust gas relief passage recessed in the upper face and in spaced relation to the main exhaust gas passage, and closed by the lower surface of the internal combustion engine, and an idle exhaust gas outlet port located in the outer surface and communicating with the idle exhaust gas relief passage, and an idle exhaust gas relief tube communicating between the main exhaust gas passage and the idle exhaust gas relief passage. The system has a portion extending vertically within the main exhaust gas passage and terminating in spaced relation above the water level in the driveshaft housing when the driveshaft housing is located in a normal operating position and when the driveshaft housing is at rest relative to the water.

U.S. Pat. No. 5,524,578, which issued to Craft et al. on Jun. 11, 1996, describes a two-cycle engine having an improved idle relief. The engine has an engine block defining at least two cylinders having respective cylinder heads. Pistons are reciprocal within the cylinders. The cylinders have respective fuel inlet ports and exhaust ports and two of the cylinders have an idle relief port disposed between their respective exhaust ports and head ends.

U.S. Pat. No. 6,663,451, which issued to Walczak on Dec. 16, 2003, discloses a siphon pump for a marine propulsion device. A fluid draining device for an outboard motor is provided with a conduit through which exhaust gases are directed. The flow of exhaust gas through the conduit induces a lowered pressure in a central portion of the structure. The reduced pressure magnitude in the central portion of the structure causes a pressure differential in a drain tube that is sufficient to induce a flow of water through the drain tube from a region to be drained toward the central portion. The device uses the Venturi effect to create the lowered pressure. The exhaust gas flow is directly through the conduit from an idle relief exhaust passage to an exhaust port from which the exhaust exits from the marine propulsion system.

The patents described above are hereby expressly incorporated by reference in the description of the present invention.

In certain configurations of outboard motors, the restrictions of certain shapes and configurations of exhaust passages can result in unwanted flow directions of exhaust gases under certain conditions. As an example, the flow restrictions caused by certain shapes and configurations within the exhaust passages can result in excessive exhaust gases passing through an idle relief system of an outboard motor even when the engine is operating at relatively high speeds. This can have an undesirable effect of directing hot exhaust gases into regions of the exhaust passages that can overheat certain components. It would therefore be significantly beneficial if a system could be devised in which the flow through an idle relief system of an outboard motor could be controlled in such a way that exhaust emissions through the idle relief system cease at an appropriate engine speed. It would be further beneficial if this flow through the idle relief system could be reversed to draw ambient air and cause the ambient air to mix with the primary exhaust flow when the engine is operating above idle speed. Lastly, it would be beneficial if a system of this type could be operated without the need for complicated mechanical valving or other moving parts.

SUMMARY OF THE INVENTION

An exhaust system for a marine propulsion system, made in accordance with a preferred embodiment of the present invention, comprises an engine having an exhaust conduit, a first exhaust passage disposed in fluid communication between the engine exhaust conduit and an underwater exhaust conduit, a second exhaust passage disposed in fluid communication between the first exhaust passage and an above-water exhaust conduit, and a flow directing component disposed in fluid communication between the first and second exhaust passages. The flow directing component is configured to conduct exhaust gases from the first exhaust passage into the second exhaust passage when the engine is operating below a first threshold speed magnitude. The flow directing component is configured to conduct a fluid from the second exhaust passage into the first exhaust passage when the engine is operating above a second threshold speed magnitude.

In a preferred embodiment of the present invention, the flow directing component comprises a tubular structure, with a first end of the tubular structure extending into the first exhaust passage. A second end of the tubular structure is disposed within the second exhaust passage. A first pressure at the first end of the tubular structure is less than a second pressure at the second end of the tubular structure in response to the engine operating at a speed above the second threshold speed magnitude. The first pressure at the first end of the tubular structure is greater than the second pressure at the second end of the tubular structure in response to the engine operating at a speed below the first threshold speed magnitude.

The first end of the tubular structure, in a preferred embodiment of the present invention, extends in a direction within said first exhaust passage which is generally aligned with the direction of flow of exhaust gases through said first exhaust passage when said engine is operating above said first threshold speed magnitude. The flow of exhaust gases causes the first pressure to be less than the second pressure when the engine is operating above the first threshold speed magnitude.

The tubular structure can be an elbow-shaped conduit. The second exhaust passage, in a preferred embodiment of the present invention, is the idle relief exhaust passage of an outboard motor. The flow directing component can be disposed within an adapter plate of the engine. The flow directing component can operate as a Venturi device when the engine is operating above the first threshold speed magnitude.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
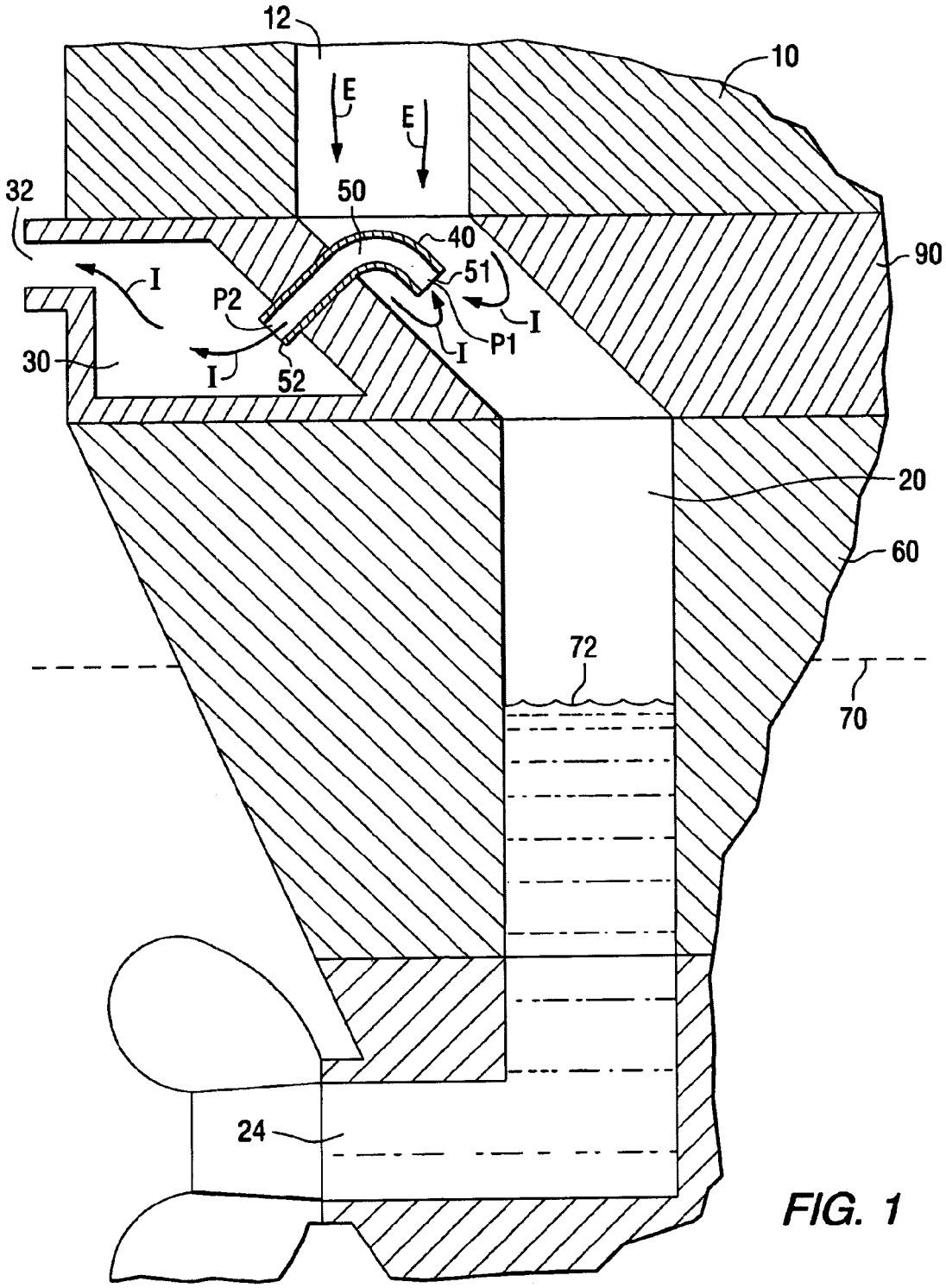
FIGS. 1 and 2 are simplified cross sections of a marine propulsion system showing the components of a preferred embodiment of the present invention.

Throughout the description of the preferred embodiment of the present invention, like components will be identified by like reference numerals.

Figure 2:
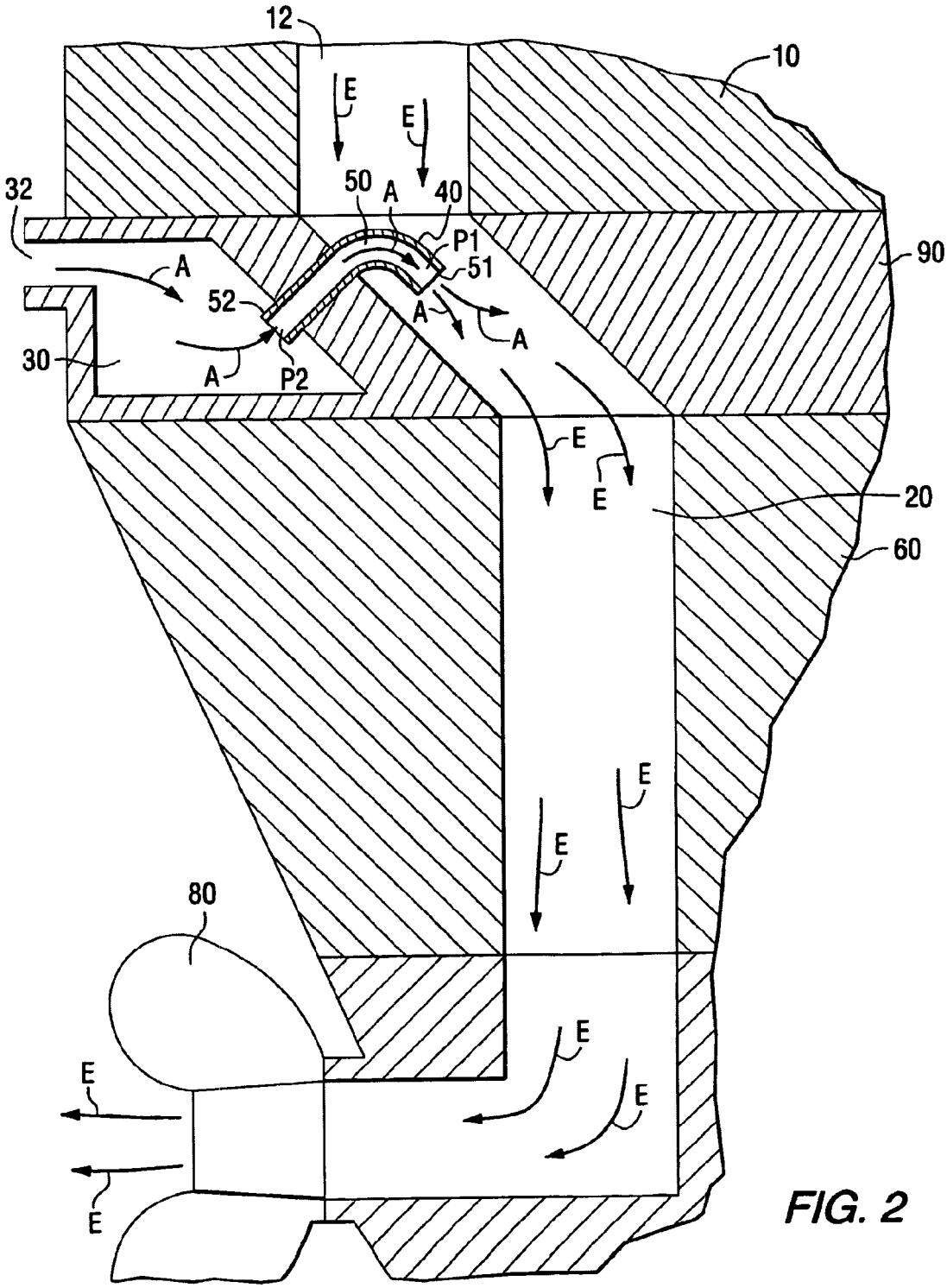

In order to describe the basic operation of a preferred embodiment of the present invention, FIGS. 1 and 2 represent highly simplified schematic representations of a cross section of the relevant exhaust portions of an outboard motor. It should be clearly understood that the exhaust passages shown in FIGS. 1 and 2 have been highly simplified so that they are illustrated in a common plane (i.e. the plane of the drawing) so that the operation of the preferred embodiment of the present invention can be fully and clearly explained under various engine operating conditions. As will be described in greater detail below, the actual exhaust passages within the structure of the outboard motor provide a much more complicated and tortuous path for the exhaust gases than is indicated in the simplified representations of FIGS. 1 and 2.

FIG. 1 is intended to show a condition of an outboard motor's exhaust system in which the engine is operating below a first threshold speed magnitude, such as at idle speed. FIG. 2 is intended to show the same outboard motor, but under conditions in which the engine is operating above a second threshold speed magnitude during which the exhaust gases are emitted at a location below the water level of a body of water in which the outboard motor is operated.

In FIG. 1, an engine 10 is provided with an exhaust conduit 12 which directs exhaust gases E downwardly from the engine 10. In many different types of marine propulsion systems, the exhaust gases E are first collected within an exhaust manifold and then directed downwardly through the exhaust conduit 12. A first exhaust passage 20 is disposed in fluid communication between the engine exhaust conduit 12 and an underwater exhaust conduit 24. A second exhaust passage 30 is disposed in fluid communication between the first exhaust passage 20 and an above-water exhaust conduit 32.

With continued reference to FIG. 1, a flow directing component 40 is disposed in fluid communication between the first and second exhaust passages, 20 and 30. The flow directing component 40 is configured to conduct exhaust gases from the first exhaust passage 20 into the second exhaust passage 30 when the engine is operating below a first threshold speed magnitude.

FIG. 1 shows the path of the idle exhaust gases, represented by arrows I. FIG. 2, on the other hand, shows the various fluid flows when the engine 10 is operating at speeds above idle speed. The flow directing component 40 is configured to conduct a fluid, such as ambient air A, from the second exhaust passage 30 into the first exhaust passage 20 when the engine 10 is operating above a second threshold speed magnitude. This flow of ambient air A is illustrated in FIG. 2.

With continued reference to FIGS. 1 and 2, the flow directing component 40 can comprise a tubular structure 50 which has a first end 51 extending into the first exhaust passage 20. A second end 52 of the tubular structure 50 is disposed within the second exhaust passage 30. A first pressure P1 at the first end 51 of the tubular structure 50 is less than a second pressure P2 at the second end 52 of the tubular structure 50 in response to the engine 10 operating at a speed above the second threshold speed magnitude. This condition is illustrated in FIG. 2. The first pressure P1 at the first end 51 of the tubular structure 50 is greater than the second pressure P2 at the second end 52 of the tubular structure 50 in response to the engine 10 operating at a speed below the first threshold speed magnitude. This condition is illustrated in FIG. 1. For purposes of reference, but not limiting to a preferred embodiment of the present invention, the first threshold speed magnitude is typically an engine speed near or slightly greater than its idle speed of approximately 600 RPM. The second threshold speed magnitude is typically an engine speed which is sufficient to cause the exhaust flow E to pass downwardly through the driveshaft housing 60 and through an underwater exhaust conduit such as the propeller exhaust illustrated in FIG. 2.

In FIG. 1, dashed line 70 represents the approximate location of the surface of a body of water in which the marine propulsion system is operating. When the engine 10 is operating at idle speed, the internal level of water 72 within the first exhaust passage 20 is generally at the same level as the surface 70 of the body of water or slightly below that level because of the pressure caused by the passage of exhaust gas E into the first exhaust passage 20 in the region above the water level 72. With the engine 10 operating at or near its idle speed, the exhaust gases fill the first exhaust passage 20 above the water level 72 and then flow through the flow directing component 40 in the direction illustrated by arrows I. From there, the idle exhaust I passes into the second exhaust chamber 30 and is emitted from the marine propulsion system through an above-water exhaust conduit 32.

As the speed of operation of the engine 10 increases, exhaust gases E flow into the first exhaust passage 20 and the water level 72 moves downward as engine speed and boat speed increase. The result is illustrated in FIG. 2, which shows the primary flow of exhaust gas E passing downwardly through the driveshaft housing 60 and being emitted from the marine propulsion system through the underwater exhaust conduit which, in FIG. 2, is illustrated as a passage existing through the hub of the propeller 80. As a result of this increased exhaust gas flow E past the first end 51 of the tubular structure 50, pressure P1 is lowered as a result of the Venturi effect to a magnitude less than the pressure P2 at the second end 52 of the tubular structure 50. This draws ambient air A in through the above-water exhaust conduit 32. As a result of this Venturi effect, two important results are achieved. First, the flow of exhaust gas in the direction I illustrated in FIG. 1 ceases. Secondly, ambient air A is drawn through the tubular structure 50 to mix with the exhaust flow E. This has the effect of lowering the temperature of the exhaust gases flowing downwardly through the first exhaust passage 20, as represented arrows E.

FIGS. 1 and 2 are highly simplified schematic representations of a marine propulsion system, such as an outboard motor, incorporating a preferred embodiment of the present invention. In the embodiment shown in FIGS. 1 and 2, the flow directing component 40 is located within an adapter plate 90 of the outboard motor. It should be understood that alternative locations of the flow directing component 40 are also within the scope of the present invention.

Figure 3:
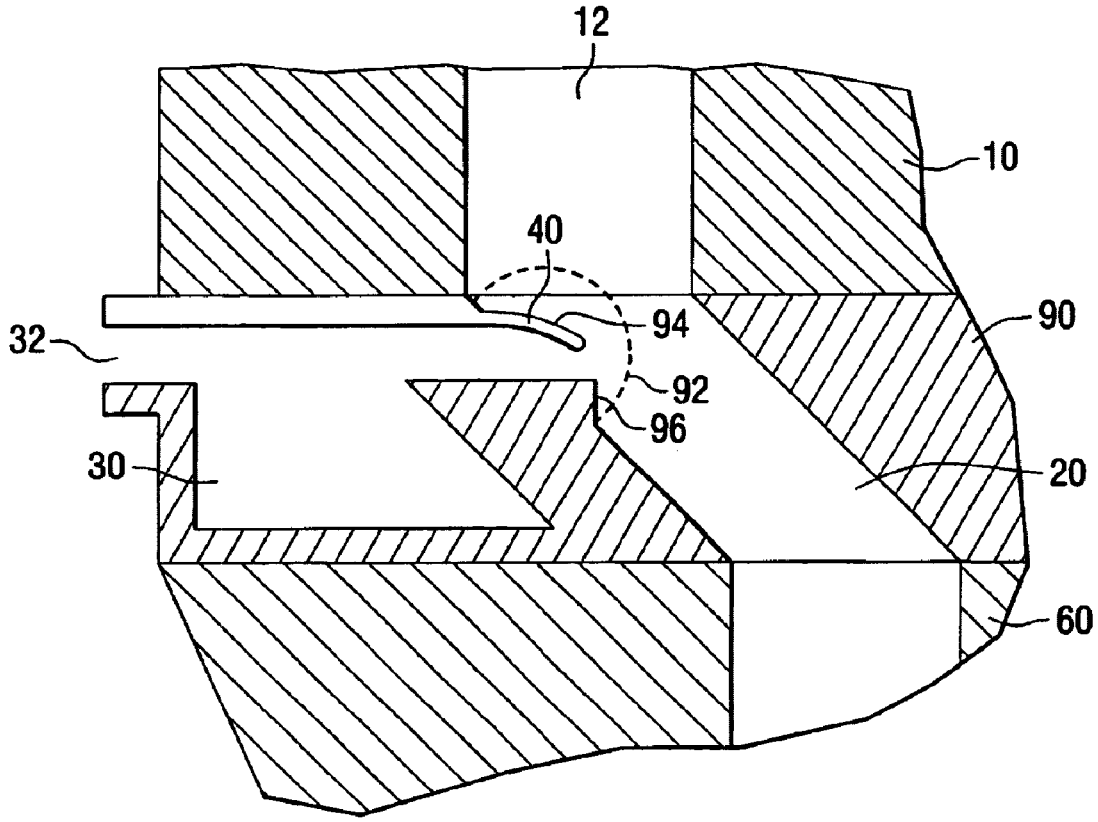
FIG. 3 shows an alternative embodiment of the present invention.

FIG. 3 is a partial view of the marine propulsion system shown schematically in FIGS. 1 and 2. It illustrates that the flow directing component 40 need not be a tubular structure, such as that identified by reference numeral 50 in FIGS. 1 and 2, in every embodiment of the present invention. The connection region, within dashed circled 92 in FIG. 3, can be shaped to induce the desired directions of flow and reversals of flow as a function of engine operating speed. In the alternative embodiment shown in FIG. 3, the adapter plate 90 is shaped to have an upper protrusion 94 and a lower protrusion 96 which serve to create the Venturi effect that induces flow from the second exhaust passage 30 into the first exhaust passage 20 when the engine 10 is operating above the second threshold speed magnitude described above. Similarly, when operating at idle speed, below the first threshold speed magnitude, the exhaust gases pass normally from the first exhaust passage 20 into the second exhaust passage 30 as described above in conjunction with FIG. 1. It should be understood that alternative configurations of the present invention can also use other alternative flow directing components.

Figure 4:
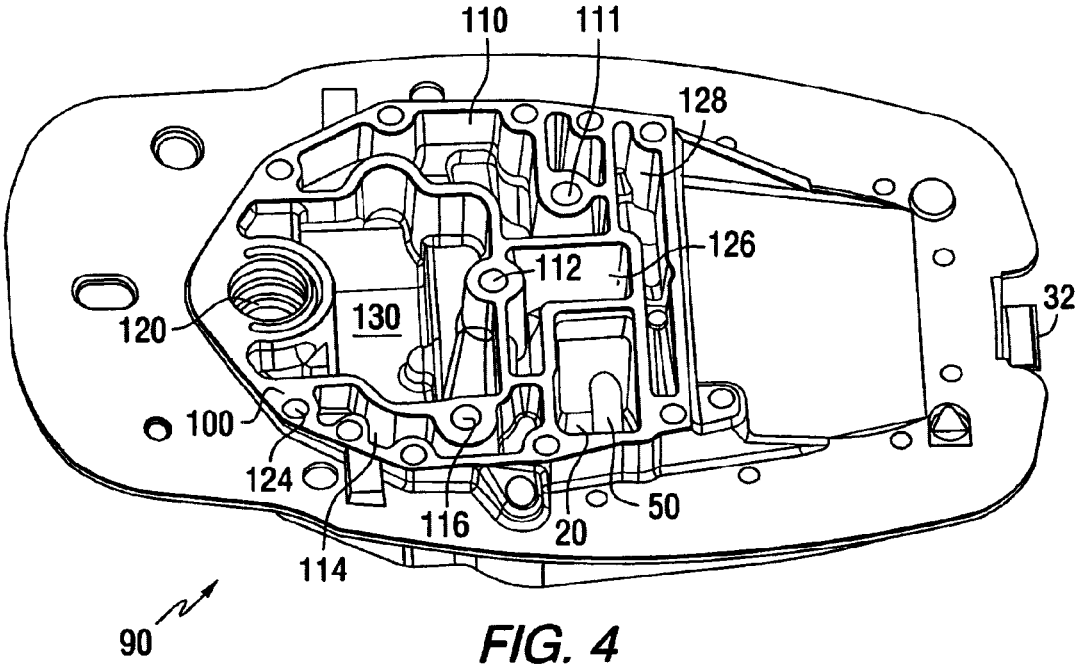
FIGS. 4 and 5 show two isometric views of an adapter plate made in accordance with a preferred embodiment of the present invention.
Figure 5:
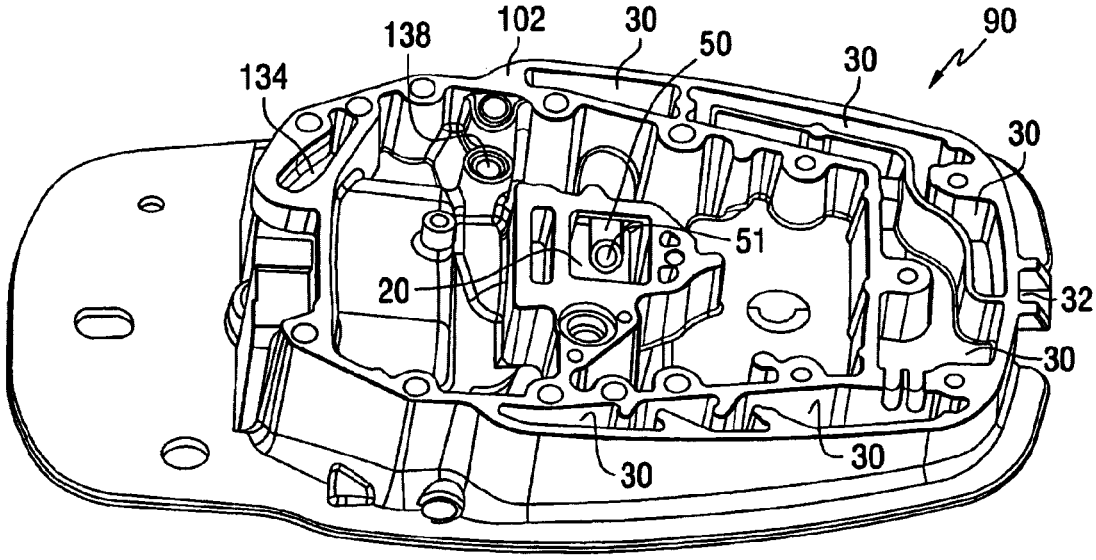

FIG. 4 shows an adapter plate 90. It has an upper surface 100 which is disposed in contact with a lower surface of the engine 10, with a gasket (not shown) disposed therebetween. FIG. 5 shows the adapter plate 90 of FIG. 4, but turned upside down to show its lower surface 102 which is normally placed in contact with an upper surface of the driveshaft housing 60.

With continued reference to FIGS. 4 and 5, the tubular structure 50 can be seen disposed within the first exhaust passage 20. The first end 51 of the tubular structure 50 can be seen in FIG. 5.

In FIGS. 1–3, the second exhaust passage 30 was represented as being contained within the plane of the drawing for purposes of simplifying and clarifying the description of the preferred embodiment of the present invention. However, the idle relief passage is much more complex and tortuous in a preferred embodiment of the present invention than represented in FIGS. 1–3. With reference to FIG. 5, the idle relief passage, or second exhaust passage 30, actually comprises the cavity formations which are shown in FIG. 5 and identified by reference numeral 30.

With continued reference to FIGS. 4 and 5, and for the purpose of providing a reference to various other passages and conduits associated with the adapter plate 90, these passages and conduits will be described briefly herein. However, it should be understood that the specific locations and shapes of these passages and conduits are not limiting to a preferred embodiment of the present invention. An oil flow passage 110 conducts oil downwardly from the engine to the sump. Similarly, opening 111 conducts oil upwardly toward conduit 112 which conducts oil downwardly. Also, cavity 114 supplies the engine with water. Opening 116 directs oil upwardly to the engine. Opening 120 provides space for the driveshaft to extend through the adapter plate 90. Water flows upwardly through conduit 134 and through cavity 114. Oil returns from the engine through the spaces identified by reference numeral 128 and 110 to return to the sump. The pocket identified by reference numeral 130 is used for mounting devices. In FIG. 5, water is directed upwardly through cavity 134, which converts to 114, toward the engine and high pressure oil is returned through conduit 138 to the sump.

Reference numeral 32 identifies the above-water exhaust conduit through which the idle exhaust flow passes out of the outboard motor when the engine is operating below the first threshold speed magnitude. Similarly, this same above-water exhaust conduit 32 allows ambient air to be drawn into the adapter plate 90 and mixed with the primary exhaust flow, as described above in conjunction with FIG. 2, when the engine is operating above a second threshold speed magnitude.

Figure 6:
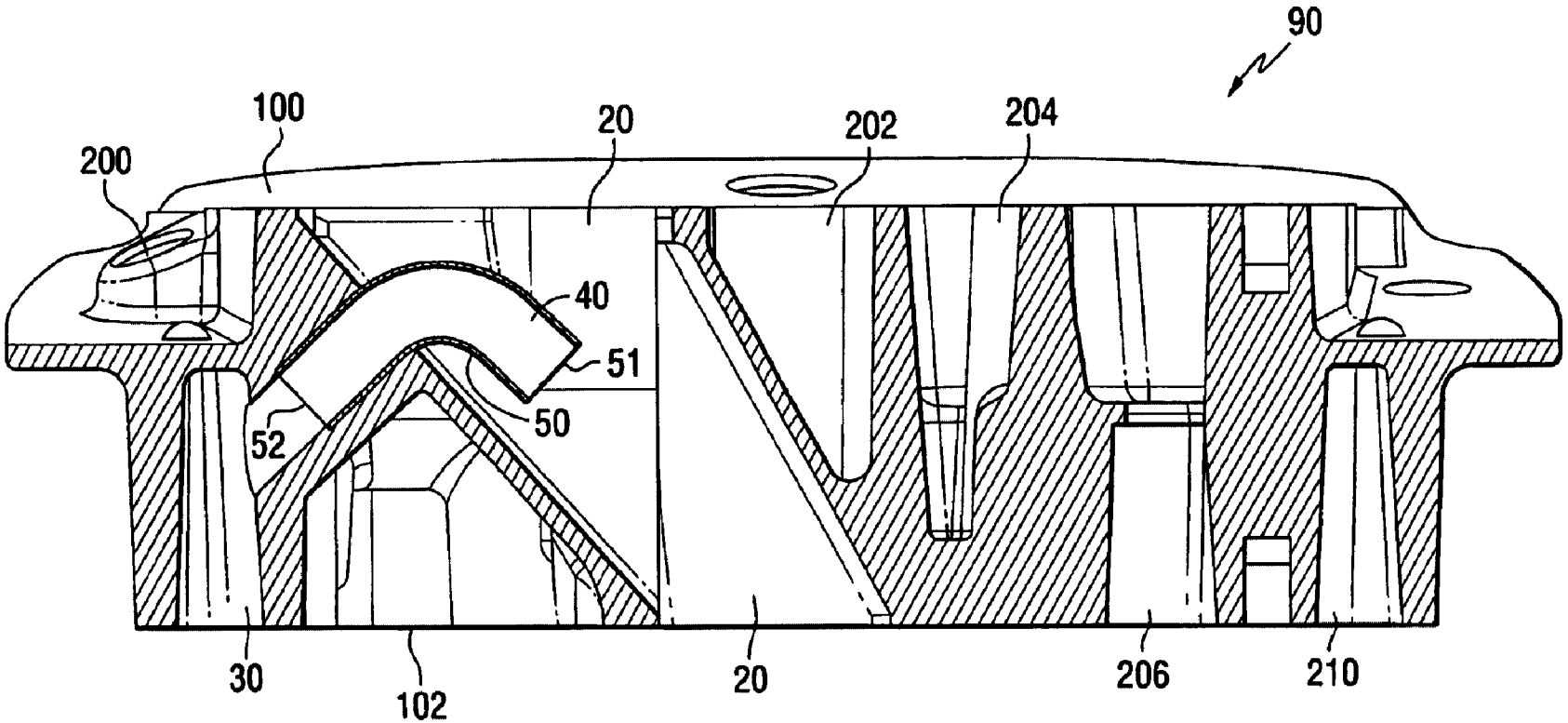
FIG. 6 is a section view of an adapter plate made in accordance with a preferred embodiment of the present invention.

FIG. 6 is a side section view taken through an adapter plate 90 of an outboard motor made in accordance with a preferred embodiment of the present invention. The first exhaust passage 20, or primary exhaust passage, extends at an angle through the thickness of the adapter plate 90. The second exhaust passage 30 is connected in fluid communication between the first exhaust passage 20 and above-water exhaust conduit which is not shown in FIG. 6. The flow directing component 40 shown in FIG. 6 is a tubular structure 50 similar to that which is described above in conjunction with FIGS. 1 and 2. Also shown in FIG. 6 are a dipstick access hole 200, a water jacket 202, an oil return passage 204, an opening 206 through which oil is allowed to return to the sump, and a portion 210 of the idle relief passage.

With reference to FIGS. 1–6, it can be seen that an exhaust system for a marine propulsion system, made in accordance with a preferred embodiment of the present invention, comprises an engine 10 having an exhaust conduit 12. It also comprises a first exhaust passage 20 disposed in fluid communication between the engine exhaust conduit 12 and an underwater exhaust conduit 24, such as the passage through propeller 80 shown in FIG. 2. A second exhaust passage 30 is disposed in fluid communication between the first exhaust passage 20 and an above-water exhaust conduit 32. The second exhaust passage 30 serves as an idle exhaust relief passage. A connection region is located at an intersection of the first and second exhaust passages, 20 and 30, and is shaped to induce a fluid flow from the second exhaust passage 30 into the first exhaust passage 20 in response to the engine 10 operating above a threshold speed magnitude. The connection region can comprise a tubular structure 50 or an arrangement which comprises a protuberance 94 as described above in conjunction with FIG. 3. The connection region is shaped to permit a fluid flow from the first exhaust passage 20 into the second exhaust passage 30 in response to the engine 10 operating below the threshold speed magnitude. The connection region can comprise a tubular structure 50 or can be shaped to comprise one or more protuberances such as those identified by reference numerals 94 and 96. The tubular structure 50 can comprise an elbow shaped conduit, such as illustrated in FIGS. 1, 2, 4, 5, and 6, or alternative configurations. The second exhaust passage 30 is an idle relief exhaust passage in a preferred embodiment of the present invention. The tubular structure 50 can operate as a Venturi device when the engine 10 is operating above the first threshold speed magnitude.

In a preferred embodiment of the present invention, the flow directing component 40 automatically results in a reversal of flow through its structure as a result of change in operating speed of the engine 10. At low speeds, when the engine 10 is operating below the first threshold speed magnitude, exhaust gases to pass from the first exhaust passage 20 into the second exhaust passage 30 and out of the above-water exhaust conduit 32. At higher engine speeds, such as above the second threshold speed magnitude, the passage of exhaust gases past the first end 51 of the flow directing component 40 lowers the pressure at the first end, relative to the pressure at the second end, and induces a flow of ambient air through the second exhaust passage 30, through the flow directing component 40, and into the first exhaust passage 20.

Although the present invention has been described in particular detail and illustrated to show a preferred embodiment, it should be understood that alternative embodiments are also within its scope.

We claim:

1. An exhaust system for a marine propulsion system, comprising:

an engine having an exhaust conduit;

a first exhaust passage disposed in fluid communication between said engine exhaust conduit and an underwater exhaust conduit;

a second exhaust passage disposed in fluid communication between said first exhaust passage and an above-water exhaust conduit; and a flow directing component disposed in fluid communication between said first and second exhaust passages, said flow directing component being configured to conduct exhaust gases from said first exhaust passage into said second exhaust passage when said engine is operating below a first threshold speed magnitude, said flow directing component being configured to conduct a fluid from said second exhaust passage into said first exhaust passage when said engine is operating above a second threshold speed magnitude.

2. The exhaust system of claim 1, wherein:

said flow directing component comprises a tubular structure, a first end of said tubular structure extending into said first exhaust passage, a second end of said tubular structure being disposed within said second exhaust passage.

3. The exhaust system of claim 2, wherein:

a first pressure at said first end of said tubular structure is less than a second pressure at said second end of said tubular structure in response to said engine operating above said second threshold speed magnitude.

4. The exhaust system of claim 3, wherein:

said first pressure at said first end of said tubular structure is greater than said second pressure at said second end of said tubular structure in response to said engine operating below said first threshold speed magnitude.

5. The exhaust system of claim 2, wherein:

said first end of said tubular structure extends in a direction within said first exhaust passage which is generally aligned with the direction of flow of exhaust gases through said first exhaust passage when said engine is operating above said first threshold speed magnitude.

6. The exhaust system of claim 5, wherein:

said flow of exhaust gases causes said first pressure to be less than said second pressure when said engine is operating above said first threshold speed magnitude.

7. The exhaust system of claim 2, wherein:

said tubular structure is an elbow shaped conduit.

8. The exhaust system of claim 1, wherein:

said second exhaust passage is an idle relief exhaust passage.

9. The exhaust system of claim 1, wherein:

said flow directing component is disposed within an adapter plate of said engine.

10. The exhaust system of claim 1, wherein:

said flow directing component operates as a Venturi device when said engine is operating above said first threshold speed magnitude.

11. An exhaust system for a marine propulsion system, comprising:

an engine having an exhaust conduit;

a first exhaust passage disposed in fluid communication between said engine exhaust conduit and an underwater exhaust conduit;

a second exhaust passage disposed in fluid communication between said first exhaust passage and an above-water exhaust conduit; and a connection region at an intersection of said first and second exhaust passages, said connection region being shaped to induce a fluid flow from said second exhaust passage into said first exhaust passage in response to said engine operating above a threshold speed magnitude.

12. The exhaust system of claim 11, wherein:

said connection region is shaped to permit a fluid flow from said first exhaust passage into said second exhaust passage in response to said engine operating below said threshold speed magnitude.

13. The exhaust system of claim 12, wherein:

said connection region comprises a tubular structure having a first end extending into said first exhaust passage and a second end disposed in fluid communication with said second passage.

14. The exhaust system of claim 13, wherein:

a first pressure at said first end of said tubular structure is less than a second pressure at said second end of said tubular structure in response to said engine operating above said threshold speed magnitude.

15. The exhaust system of claim 14, wherein:

said first pressure at said first end of said tubular structure is greater than said second pressure at said second end of said tubular structure in response to said engine operating below said first threshold speed magnitude.

16. The exhaust system of claim 13, wherein:

said first end of said tubular structure extends in a direction within said first exhaust passage which is generally aligned with the direction of flow of exhaust gases through said first exhaust passage when said engine is operating above said first threshold speed magnitude.

17. The exhaust system of claim 16, wherein:

said tubular structure is an elbow shaped conduit;

said second exhaust passage is an idle relief exhaust passage; and said tubular structure operates as a Venturi device when said engine is operating above said first threshold speed magnitude.

18. An exhaust system for a marine propulsion system, comprising:

an engine having an exhaust conduit;

a first exhaust passage disposed in fluid communication between said engine exhaust conduit and an underwater exhaust conduit;

a second exhaust passage disposed in fluid communication between said first exhaust passage and an above-water exhaust conduit; and a flow directing component disposed in fluid communication between said first and second exhaust passages, said flow directing component being configured to conduct exhaust gases from said first exhaust passage into said second exhaust passage when said engine is operating below a first threshold speed magnitude, said flow directing component being configured to conduct a fluid from said second exhaust passage into said first exhaust passage when said engine is operating above a second threshold speed magnitude, a first end of said flow directing component extending into said first exhaust passage, a second end of said flow directing component being disposed within said second exhaust passage, a first pressure at said first end of said flow directing component being less than a second pressure at said second end of said flow directing component in response to said engine operating above said second threshold speed magnitude, said first pressure at said first end of said flow directing component being greater than said second pressure at said second end of said flow directing component in response to said engine operating below said first threshold speed magnitude.

19. The exhaust system of claim 18, wherein:

said first end of said tubular structure extends in a direction within said first exhaust passage which is generally aligned with the direction of flow of exhaust gases through said first exhaust passage when said engine is operating above said first threshold speed magnitude.

20. The exhaust system of claim 19, wherein:

said flow of exhaust gases causes said first pressure to be less than said second pressure when said engine is operating above said first threshold speed magnitude.

* * * * *